US009239206B1

(12) United States Patent
Nguyen

(10) Patent No.: US 9,239,206 B1
(45) Date of Patent: Jan. 19, 2016

(54) TOY PROJECTILE LAUNCHER

(71) Applicant: Mattel, Inc., El Segundo, CA (US)

(72) Inventor: Viet Nguyen, Lakewood, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/453,582

(22) Filed: Aug. 6, 2014

Related U.S. Application Data

(60) Provisional application No. 61/863,379, filed on Aug. 7, 2013.

(51) Int. Cl.
*F41B 11/642* (2013.01)
*F41B 11/70* (2013.01)

(52) U.S. Cl.
CPC ..... *F41B 11/70* (2013.01); *F41B 11/642* (2013.01)

(58) Field of Classification Search
CPC ..... F41B 11/642; F41B 11/643; F41B 11/646
USPC ..... 124/65–67
See application file for complete search history.

(56) References Cited

U.S. PATENT DOCUMENTS

| | | | | |
|---|---|---|---|---|
| 1,760,652 | A | 5/1930 | Loomis | |
| 3,370,581 | A | 2/1968 | Hills et al. | |
| 4,141,166 | A | 2/1979 | Schultz | |
| 4,367,723 | A | 1/1983 | Resuggan | |
| 4,834,059 | A | 5/1989 | Moorhouse et al. | |
| 5,429,108 | A | 7/1995 | Hsieh | |
| 5,586,545 | A | 12/1996 | McCaslin | |
| 5,653,215 | A | 8/1997 | Chung et al. | |
| 6,220,237 | B1 | 4/2001 | Johnson et al. | |
| 6,408,837 | B1 | 6/2002 | Johnson et al. | |
| 6,807,959 | B1 | 10/2004 | Murdock et al. | |
| 7,185,645 | B1 | 3/2007 | Neumeir et al. | |
| 7,481,209 | B1 | 1/2009 | Bligh et al. | |
| 7,686,003 | B2 | 3/2010 | Witzigreuter | |
| 7,698,846 | B2 | 4/2010 | Do Amarante et al. | |
| 7,849,845 | B2 | 12/2010 | Page et al. | |
| 8,082,909 | B2 | 12/2011 | Sopinsky | |
| 8,387,605 | B2 * | 3/2013 | Brown et al. | 124/27 |
| 8,726,894 | B2 * | 5/2014 | Carlson et al. | 124/66 |
| 2010/0024792 | A1 | 2/2010 | Wood | |
| 2010/0282227 | A1 * | 11/2010 | Vanek | 124/27 |
| 2012/0125304 | A1 * | 5/2012 | Brooks et al. | 124/52 |

* cited by examiner

*Primary Examiner* — Reginald Tillman, Jr.
(74) *Attorney, Agent, or Firm* — The Mueller Law Office, P.C.

(57) ABSTRACT

A toy projectile launcher includes a plunger in an air chamber. The plunger is engaged with a spring and is able to be coupled to a non-locking handle. The plunger is movable between an inactive position and a firing position. The non-locking handle moves the plunger from the inactive position to the firing position to compress the spring, and is unable to lock the spring at the firing position. A plunger release mechanism couples and releases the handle from the plunger. In the firing position a trigger is capable of engaging the plunger release mechanism, and the trigger is located at a distance from the non-locking handle such that both the non-locking handle and the trigger cannot be engaged simultaneously by a single hand of a user. Both the non-locking handle and the trigger must be engaged simultaneously to launch the projectile.

19 Claims, 7 Drawing Sheets

TOY PROJECTILE LAUNCHER

RELATED APPLICATIONS

This application claims priority to U.S. Provisional Patent Application No. 61/863,379 filed on Aug. 7, 2013, and entitled "Toy Projectile Launcher," which is hereby incorporated by reference for all purposes.

BACKGROUND OF THE INVENTION

Toy projectile launchers have long been a source of amusement for both children and adults, and have been seen in many configurations. While design features often address various ways to launch projectiles, safety features for the launchers to prevent injury to users have also been provided in various forms. For example, air discharge valves have been incorporated into compressed air launchers to render a launcher inoperable when not in use, or to allow a user to release the air pressure manually from a charged pressure chamber. Other safety features involve the preventing of unwanted triggering of a launcher, such as by using magnetic locks, user identification requirements, or safety buttons that must be depressed to allow the trigger to be pulled. In further examples, designs have included safety features to prevent unwanted projectiles from being loaded or discharged, and mechanisms to reduce potential injury due to recoil.

As new types of toy projectile launchers continue to be developed and become more advanced, there remains a need for improved safety features in these toys.

SUMMARY

A toy projectile launcher includes a barrel in fluid communication with an air chamber, where the barrel is configured to hold a projectile. A plunger or piston in the air chamber is coupled to a spring, and a non-locking handle is coupled to the plunger. The plunger has an inactive position in which air in the air chamber is uncompressed and the spring is in a non-energized state. The plunger can be moved from the inactive position to a loaded or cocked or firing position in which the spring is compressed and energized.

The non-locking handle moves the plunger and the spring from the inactive position to the loaded or firing position, and is unable to lock the plunger at the firing position. A plunger release mechanism is capable of holding and releasing the handle from the plunger. A trigger is capable of releasing the plunger release mechanism when the handle is in the firing position, and is unable to release the plunger release mechanism in the inactive position. In the firing position, the trigger is located at a distance from the non-locking handle such that both the non-locking handle and the trigger cannot be engaged simultaneously by a single hand of a user. Both the non-locking handle and the trigger must be engaged simultaneously to launch the projectile. When the trigger decouples the plunger release mechanism from the handle, the plunger is released, thereby compressing air to launch the projectile.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Toy projectile launchers have long been and continue to be a popular source of play amusement for people of all ages. As launching features become more advanced, such as by increasing projectile distance and the number of projectiles that can be launched, there is a need to maintain safe play for the user. In the present disclosure, a toy projectile launcher maintains a non-stored energy state unless actively engaged in a two-handed operation by a user for launching a projectile. During normal operation, in order to launch a projectile, a handle is held by a first hand of a user while a second hand of the user activates a trigger. The handle is coupled to a spring and plunger such that if the handle is released by the first hand, the handle and consequently the plunger return to their resting, non-stored energy positions. Thus, the non-stored energy launcher requires two distinct motions for operation—holding the handle in a firing position with one hand and activating the trigger with a second hand. Furthermore, in the inactive position the trigger is not coupled to or engaged with the launching mechanisms such that the trigger is incapable of causing a projectile to be launched. Therefore, the handle must be held in its firing position in order for the trigger to be able to launch a projectile.

Figure 1:
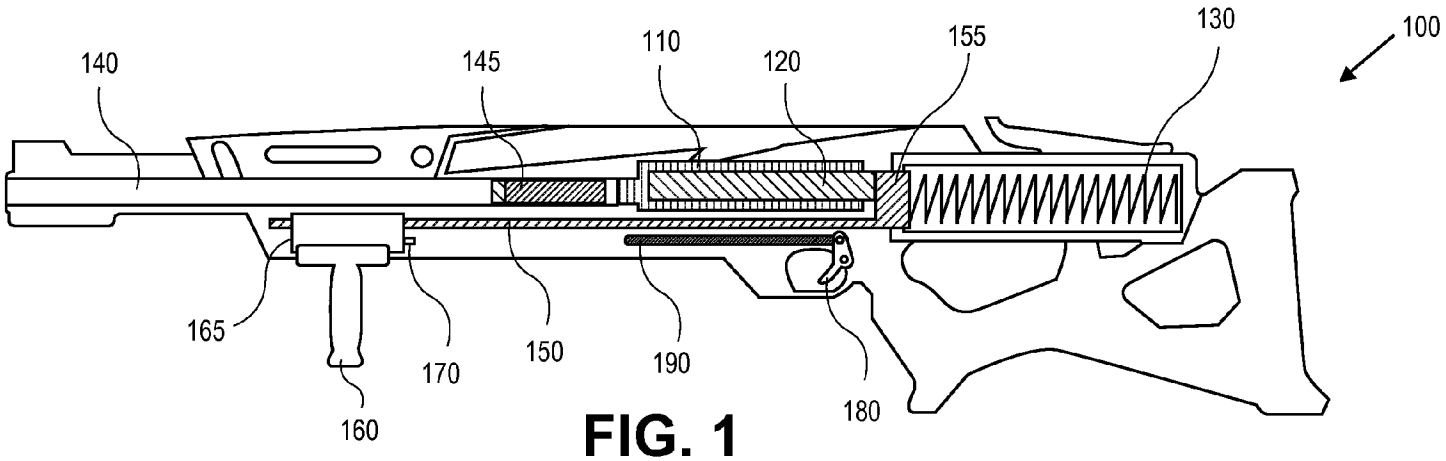
FIG. 1 shows a side cross-sectional view of an exemplary embodiment of a projectile launcher in an inactive state.

FIG. 1 illustrates a side cross-sectional view of one embodiment of a projectile launcher 100 which includes an air chamber 110, a plunger 120 within the air chamber 110, and a spring 130 coupled to the plunger 120. A barrel 140 is in fluid communication with the air chamber 110 and is configured to hold or receive a projectile 145, shown in this embodiment as a dart. However, other configurations of projectiles as known in the art, such as foam darts, are possible. Projectile 145 may be manually loaded or automatically fed into the barrel, such as by a magazine or ammunition belt (not shown). The projectile launcher 100 also includes unique components for a non-stored energy design, comprising a rail 150 coupling the plunger to a handle 160, a handle sled 165 fixedly attached to handle 160, a plunger release mechanism 170 mounted in handle sled 165, a trigger 180, and a rod 190 coupled to the trigger 180. Handle 160 in this embodiment is configured as a vertical grip, approximately perpendicular to the longitudinal axis of the launcher 100, that can be grasped by a user. The launcher 100 in FIG. 1 is shown in an inactive position, in which the handle 160 is forward—i.e., closer to the tip of the launcher 100 than to the trigger 180—and the spring 130 is non-energized. In this embodiment, spring 130 is a compression spring and has this non-energized state in which the spring is extended. When the spring 130 is in this resting state, the air in the air chamber 110 is uncompressed and there is no energy stored in the spring 130. Note that although a spring is described in this disclosure, other equivalent biasing elements may be utilized.

The handle sled 165, and consequently handle 160, slides along rail 150. Rail 150 has an extension or tab 155 coupled to the junction of where the plunger 120 meets the spring 130, and thus rail 150 couples handle 160 to the spring 130. Plunger release mechanism 170 releasably couples handle 160 (including handle sled 165) to the rail 150 such that the handle 160 is normally locked to the rail 150, but is released from the rail 150 when the mechanism 170 is released. In the embodiment of FIG. 1, mechanism 170 is shown as a push button, but may take other forms such as, but not limited to, a lever or knob. The releasable locking between plunger release mechanism 170 and rail 150 may be achieved by, for example, a spring-loaded or magnetic element coupled with a detent, a tab, a groove, or a clamp.

Figure 2:
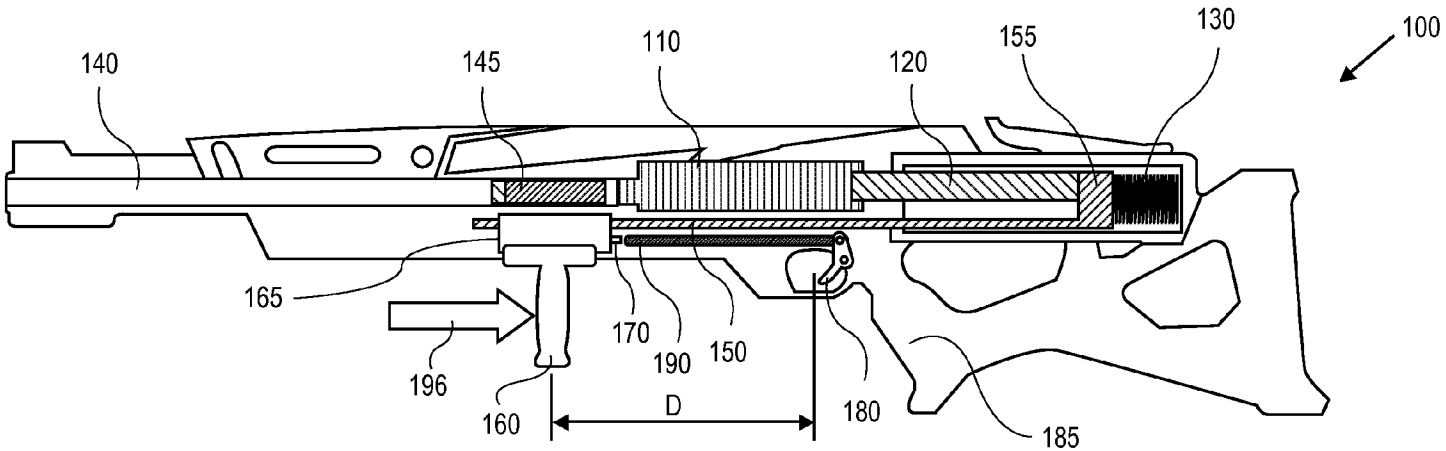
FIG. 2 shows the launcher of FIG. 1 in a firing position.

FIG. 2 illustrates the plunger 120 and handle 160 in a firing position. In the firing position, a user pulls handle 160 toward the trigger 180 as indicated by arrow 196, thereby compressing and energizing the spring 130. The spring force of spring 130 resists movement of the handle 160 from the inactive position to the firing position. The handle 160 is non-locking—that is, there are no mechanisms to hold the handle 160 in the firing position. Therefore, handle 160 requires active engagement of the user to prepare and hold the handle 160 for firing. This active engagement beneficially provides safety to the user in that the user must intentionally apply a force to enable the launcher to be activated.

In the firing position, the rod 190 is aligned with mechanism 170, and is in a position to actuate mechanism 170 when trigger 180 is pulled. When the handle 160 is in the inactive position (FIG. 1), the trigger 180 is unable to actuate mechanism 170 due to the separation between trigger 180 and mechanism 170. In the firing position of FIG. 2, the rod 190 has a length specifically designed to maintain a distance "D" between handle 160 and trigger 180, such that a user's first hand holding handle 160 is unable to reach or pull the trigger 180. Instead, a user's second hand, holding stock 185, is required to actuate trigger 180, which provides additional safety in operation of the launcher. In other words, in the firing position the trigger 180 is located a distance from the non-locking handle 160 such that both the handle 160 and the trigger 180 cannot be engaged simultaneously by a single hand of a user. The distance "D" is measured from the point at which a user can hold the handle 160 to the closest end of trigger 180. In FIG. 2 "D" is shown from the centerline of the handle 160 to the front edge of trigger 180. In other embodiments in which the handle is shaped other than a vertical bar, the distance "D" is the minimum distance between the holding area of the handle and the trigger. For example, in the case of a loop-shaped handle, "D" would be measured from the side of the loop that is nearest the trigger. In the embodiment of FIG. 2, the separation between the handle and trigger is achieved by the rod 190 having a length such that the distance between trigger 180 and handle 160 is greater than a grip distance of a user's hand. In some embodiments the distance between the trigger 180 and the handle 160 in the firing position may be, for example, at least 6 inches, or at least 8 inches.

Figure 3:
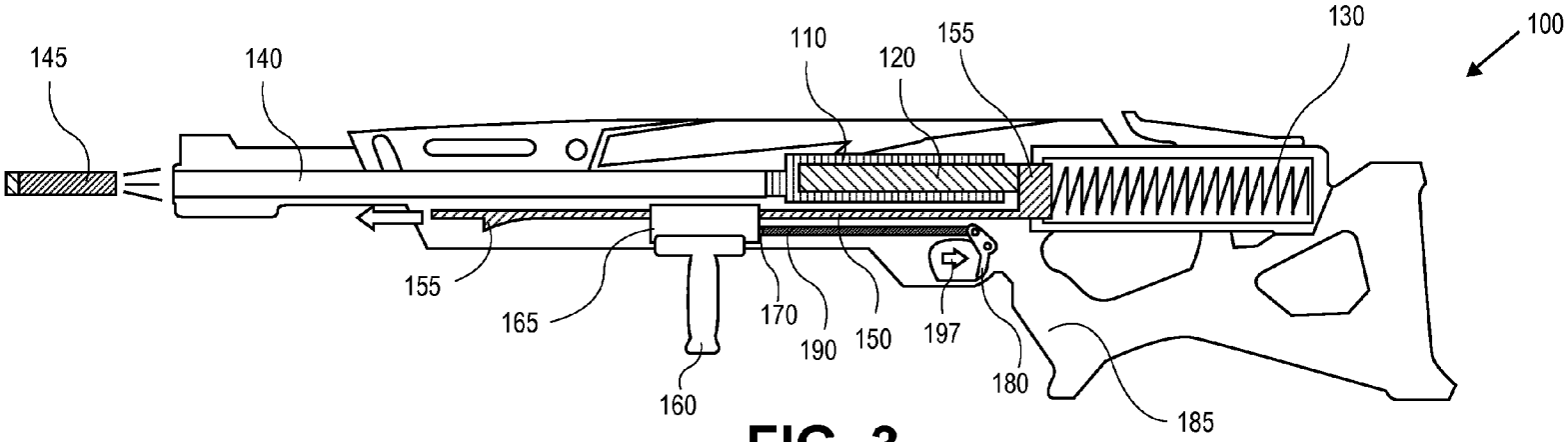
FIG. 3 shows the launcher of FIG. 2 after a projectile has been launched.

FIG. 3 depicts a state in which a projectile is being launched. In normal operation, a user must engage both the non-locking handle 160 and the trigger 180 simultaneously as described above—by holding the handle 160 in the firing position with one hand and pulling the trigger 180 with their other hand—in order to launch the projectile. When trigger 180 is actuated by a user as indicated by arrow 197, trigger 180 pivots and pushes rod 190 forward, and rod 190 then contacts mechanism 170 which releases handle 160 from the rail 150. In the embodiment of FIG. 3, rail 150 is configured with a tab 155, to serve as a locking element to engage with plunger release mechanism 170 in handle sled 165. In FIG. 3, actuation of the trigger 180 has disengaged tab 155 from trigger mechanism 170, and thus handle sled 165 is able to slide along rail 150. Because the user is holding handle 160 when the trigger 180 is pulled, the handle 160 stays in place while the rail 150 moves forward. Releasing the rail 150 causes the spring 130 to be released and plunger 120 to be moved forward, forcing air in the air chamber 110 to launch projectile 145 out of the barrel 140. Thus, releasing the plunger release mechanism 170 decouples the plunger 120 from the handle 160 and enables the compressed air to launch the projectile 145.

Figure 4:
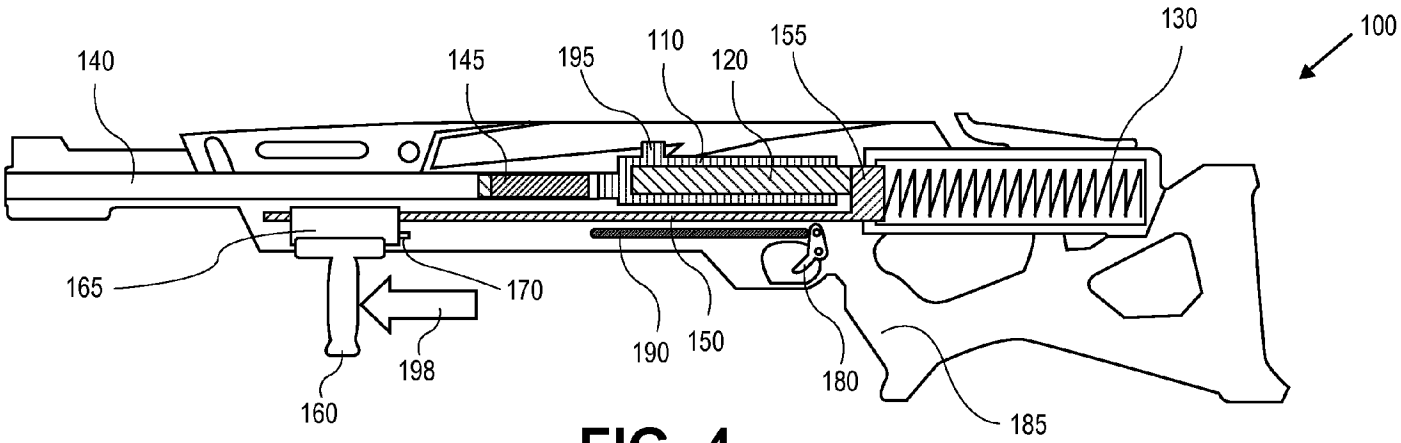
FIG. 4 shows the launcher of FIG. 2 when the handle has been released by a user but a projectile has not been launched.

FIG. 4 shows an alternate state of the launcher after a user has prepared the launcher 100 for firing. After pulling the handle 160 into firing position, if the user ceases their hold on handle 160 at any time without having launched the projectile, the handle 160 will return to its starting, inactive position due to handle being coupled with or engaged by compressed spring 130. As previously described, the non-locking handle 160 is beneficially absent of any locking elements to secure the handle in the firing position, and thus the launcher 100 is unable to store energy unless a user is actively holding the handle 160 in its retracted position. When the launcher 100 is not in use, the launcher 100 inherently returns to a non-stored energy state since energy cannot be stored or locked in the spring without active user interaction. This non-locking handle feature reduces unintentional firing. Additionally, the requirement of a two-handed operation to launch a projectile, due to the distance between the handle and the trigger, reduces the unintentional firing of the launcher.

FIG. 4 also depicts an optional secondary air valve 195 in fluid communication with air chamber 110 and to ambient air. Secondary air valve 195 fluidly couples the air chamber 110 to ambient air. Air valve 195 may be used, for example, to bleed off compressed air if the trigger is not pulled. If desired, air valve 195 may optionally be designed to operate at a specific release pressure to slow down the return speed of handle 160 to the inactive position after launching a projectile, depending on the levels of air pressure for which the launcher is configured.

Figure 5:
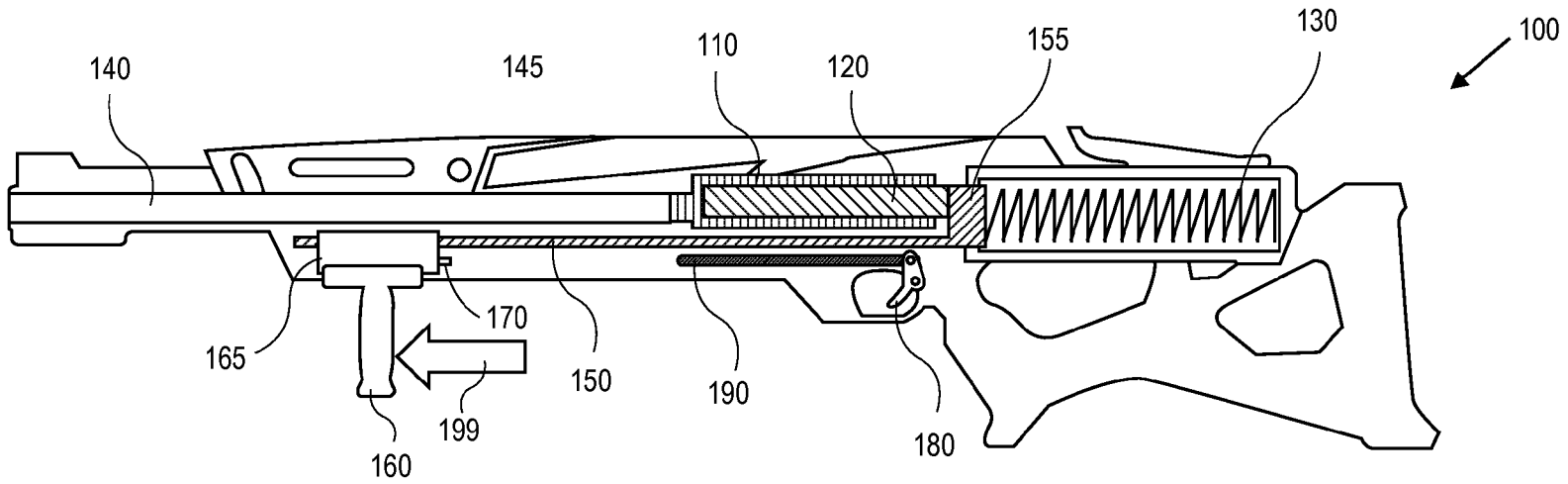
FIG. 5 shows an illustration of the launcher of FIG. 3 being reset for another launching.

FIG. 5 shows the launcher 100 after a projectile has been released. In this state, the spring 130 and plunger 120 are in their uncompressed states. The user may now manually slide handle 160 forward, as indicated by the arrow 199, to re-engage the handle sled 165 with the rail 150. For example, the handle sled 165 may be engaged with rail 150 using tab 155 of FIG. 3, or using other mechanisms such as, but not limited to, magnets, latches, or electrical switches. After returning the handle 160 to its forward, inactive position where it is secured to the rail, the launcher 100 is now ready to use again.

Figure 6:
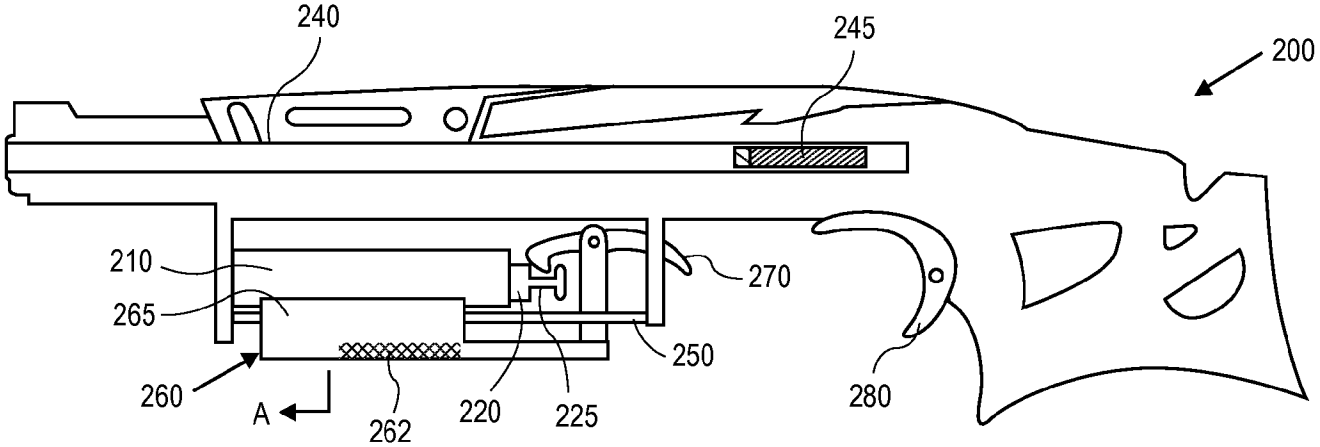
FIG. 6 shows a side cross-sectional view of another embodiment of a launcher.

FIG. 6 shows another embodiment of a projectile launcher 200 which includes an air chamber 210, a plunger 220 within air chamber 210, and a barrel 240 configured to hold a projectile 245. In this embodiment, air chamber 210 is not in-line with barrel 240 as are the barrel 140 and air chamber 110 in FIG. 1. Rather, the air chamber 210 is mounted below barrel 240, and is in fluid communication with barrel 240 via tubing or other air passageways (not shown) to enable air from the air chamber 210 and launch a projectile 245.

Figure 7A:
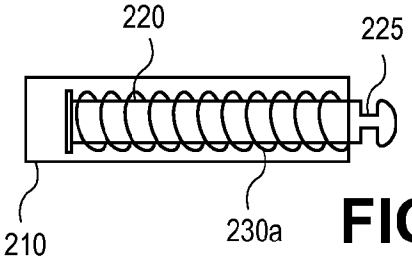
FIGS. 7A and 7B shows side cross-sectional views of two embodiments of the air chamber of FIG. 6.
Figure 7B:
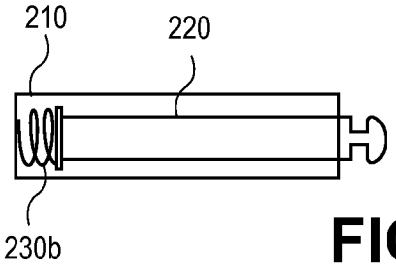

FIGS. 7A and 7B show side cross-sectional views of the air chamber 210 and plunger 220. In the embodiment of FIG. 7A, a spring 230*a* is a compression spring, such that it is biased to be in its expanded, non-energized state. When the plunger 220 is moved to extend out of air chamber 210, the spring 230*a* will be compressed and therefore energized. In the embodiment of FIG. 7B, a spring 230*b* is a tension spring, such that it is biased to be in its compressed, non-energized state. Spring 230*b* is attached to the end of plunger 220. When the plunger 220 is pulled outward from air chamber 210, spring 230*b* will store energy as it is extended. Either of these springs 230*a* or 230*b* is possible to use in launcher 200. For launcher 200 of FIG. 6, plunger 220 also includes a detent 225 to allow it to be coupled to the handle, which shall be described subsequently in more detail.

Figure 8:
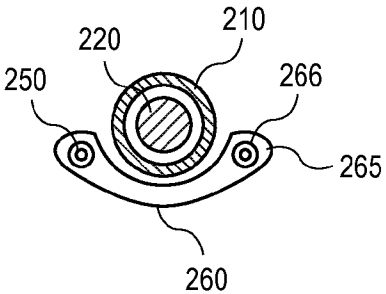
FIG. 8 shows an area cross-sectional view of the partial section "A" of FIG. 6.

Returning to FIG. 6, a rail 250 runs alongside the air chamber 210. A handle 260 includes a handle sled 265, which slidably couples handle 260 to rail 250. In this embodiment, handle 260 has a horizontal gripping area 262 that can be grasped by a user to slide the handle 260 along the rail 250. In other embodiments, the gripping area 262 may be replaced by a vertical grip as in FIG. 1, or by other designs for allowing a user to pull on a handle such as, but not limited to, a loop, a curved grip, or a knob. FIG. 8 is a simplified cross-sectional view taken at section "A" of FIG. 6, showing the air chamber 210, plunger 220, and handle 260. Handle 260 in this embodiment forms a curved horizontal track around the lower portion of air chamber 210. Handle sled 265 is configured with channels 266 through which rails 250 are seated, to enable handle 260 to slide along rails 250. In this embodiment of FIG. 8, two rails 250 are shown on either side of air chamber 210. However, in other embodiments, only one rail may be used, or more than two may be possible. Furthermore, while the rails 250 are shown with a circular cross-section in FIG. 8, the rails 250 may have other shapes, such as but not limited to rectangular, I-beam, or oval.

FIG. 6 additionally depicts a plunger release mechanism 270 coupled to handle 260. Plunger release mechanism 270 in this embodiment is configured as a hooked lever, which engages with detent 225 at the end of plunger 220. Thus, plunger release mechanism 270 couples handle 260 to plunger 220, rather than the handle 160 to the rail 150 as in launcher 100. In other embodiments release mechanism 270 and detent 225 may be configured as other releasable coupling mechanisms, such as magnetic couplings, snap fit elements, or spring-loaded elements.

The launcher 200 in FIG. 6 is shown in a resting inactive state, such that the handle 260 is forward—that is, toward the tip of barrel 240. The spring in air chamber 210 is non-energized, such as being uncompressed in the case of the compression spring 230*a* of FIG. 7A. Plunger release mechanism 270 engages detent 225. In some embodiments, the lever mechanism 270 may naturally lower itself and engage detent 225 due to the weight of the lever mechanism 270. When the handle 260 is in the inactive position, the trigger 280 is beneficially spaced apart from release mechanism 270 and thus is unable to launch a projectile.

Figure 9:
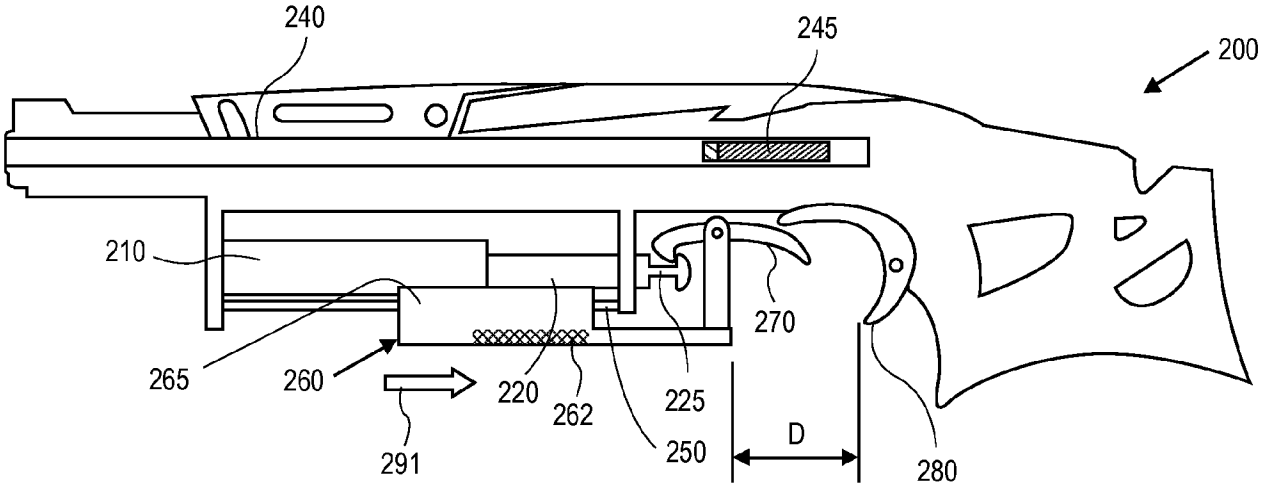
FIG. 9 shows the launcher of FIG. 6 in a position ready for launching.

FIG. 9 shows the launcher 200 in a firing position. In operation, a user grips handle 260 and slides it along rail 250 as indicated by arrow 291, toward trigger 280. Because plunger release mechanism 270 is engaged with plunger 220, the plunger 220 is extended outwardly from air chamber 210 when the handle 260 is moved. Handle 260 is non-locking—that is, it is unable to be locked in this retracted firing position without being held actively by the user. Since the spring 230*a/b* becomes energized when the handle 260 is pulled into firing position, the handle 260 will automatically return to the inactive position (FIG. 6) if a user releases their grip. Thus the launcher 200 is unable to store energy without active user engagement, which advantageously serves as a safety feature for launcher 200. In addition, because gripping area 262 is essentially a horizontal surface—that is, a gripping area which is aligned only with the longitudinal axis of the launcher—the user must actively hold the handle with a first hand to keep the handle 260 in the firing position. Consequently, the trigger 280 must be actuated by the user's second hand. This two-handed operation further helps prevent unintentional launching of a projectile.

In FIG. 9, when the handle 260 is in the firing position, the trigger 280 is capable of contacting the release mechanism 270. However, the distance "D" between handle 260 and trigger 280 is large enough to prevent a user from engaging both elements with a single hand. Because the handle 260 must be actively held while the trigger 280 is pulled, the launching of a projectile therefore typically requires simultaneous engagement of both of a user's hands. In FIG. 9, "D" is measured from the back end of the handle 260 to the front end of the trigger 280, which is the minimum distance at which a user might attempt to reach both the handle 260 and trigger 280 with one hand.

Figure 10:
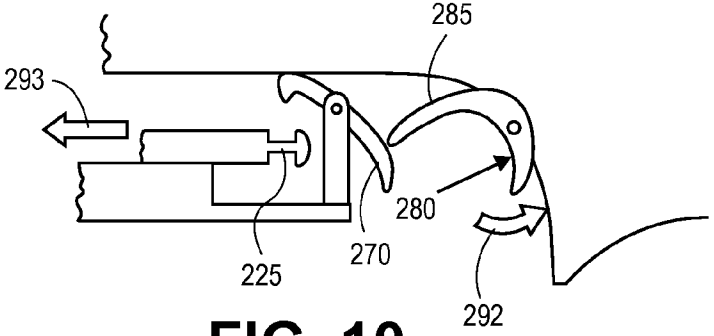
FIG. 10 provides a detailed view of the trigger actuation in FIG. 9.

A detailed view of trigger actuation is shown in FIG. 10. When the trigger 280 is pulled, the trigger 280 pivots as shown by arrow 292, in which the upper arm 285 of trigger 280 pushes down on the lever-shaped release mechanism 270. As the release mechanism 270 is actuated, the detent 225 in the tip of plunger 220 is released, allowing the spring 230*a/b* to return plunger 220 to its initial position (indicated by arrow 293), thereby compressing air in air chamber 210 which is released to launch projectile 245.

Figure 11:
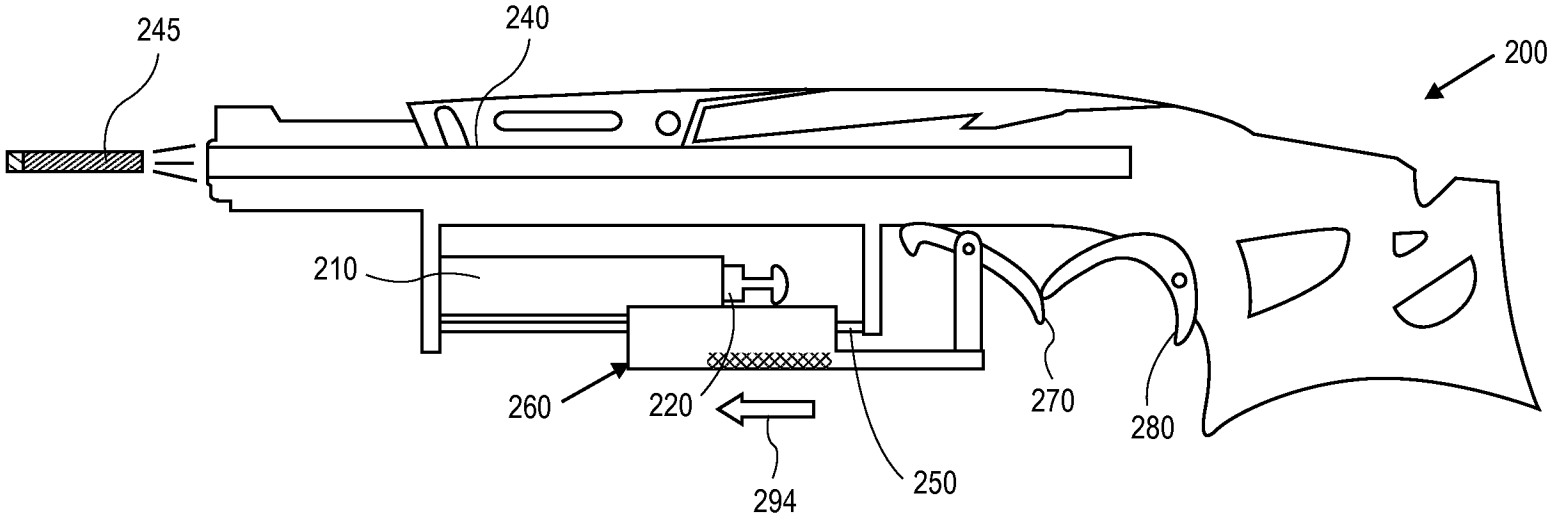
FIG. 11 depicts the launcher of FIG. 9 being returned to its inactive state after a projectile has been deployed.

FIG. 11 shows the launcher 200 in a state after the projectile 245 has been deployed, in which the plunger 220 has returned to its initial position within air chamber 210 due to the de-energizing of spring 230. Because handle 260 has been de-coupled from the plunger 220 and consequently from spring 230 due to release of the release mechanism 270, handle 260 remains in its firing position. A user may then manually return the handle 260 to its forward position, as indicated by arrow 294, to reset the launcher 200 for firing. When handle 260 is moved forward, plunger release mechanism 270 will again engage detent 225 of plunger 220. Trigger 280 may be coupled to a spring or other elastic element (not shown) to return trigger 280 to its unactuated position when a user removes their finger.

Note that while the two-handed operation by a user as presented in the various embodiments above may be achieved by utilizing a second person or a mechanical device instead of the user's second hand, the intended purpose of the projectile launchers described herein is for operation by a sole user. Furthermore, variations of the embodiments are possible without departing from the scope of the invention. For example, the vertical grip handle may be foldable, target sighting accessories may be added, or rapid firing abilities may be incorporated into the trigger. In other examples, the trigger may be configured as a push button instead of a lever arm; or the overall shape of the launcher may take different forms such as a rifle, a pistol, or a disk launcher.

Figure 12:
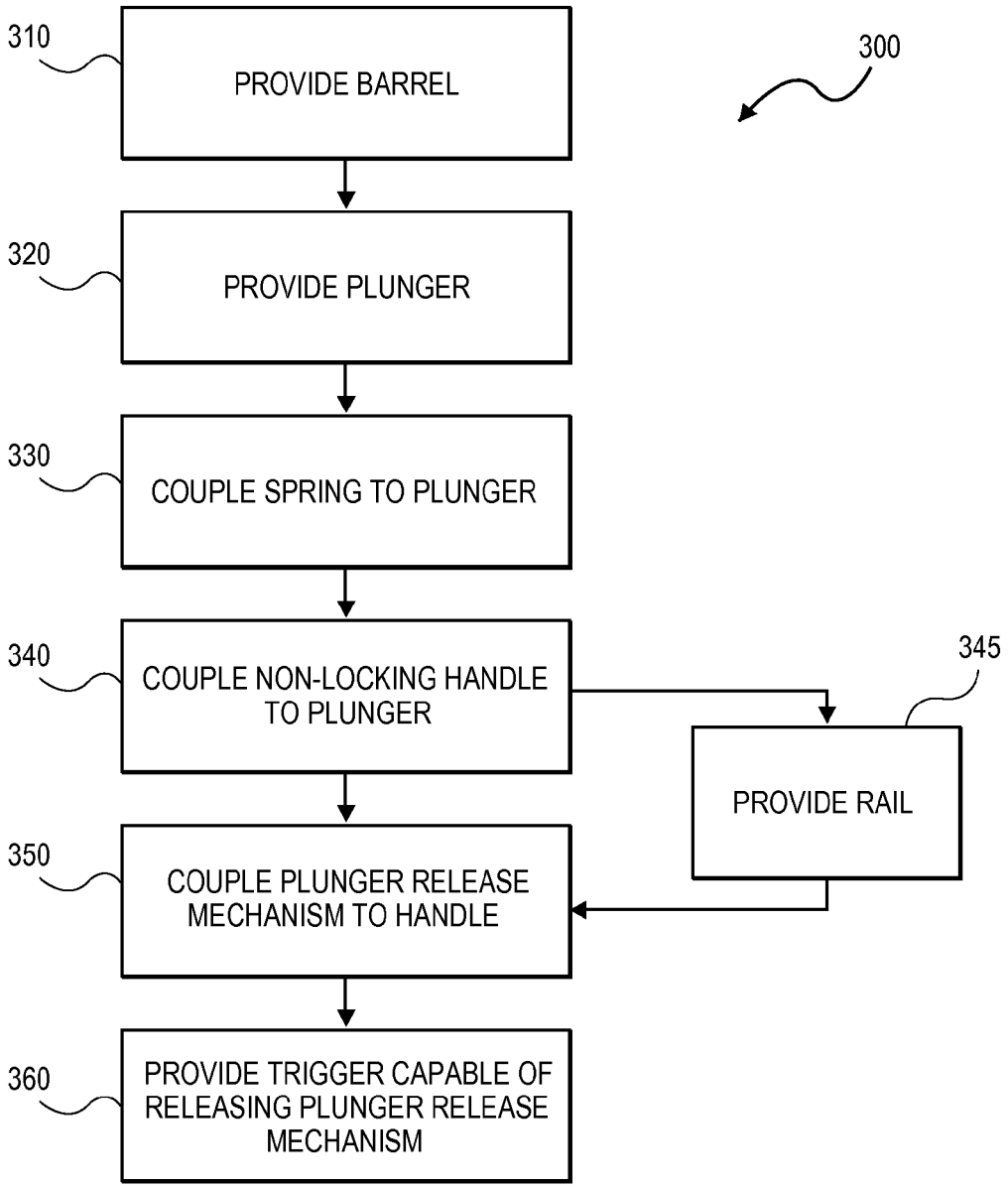
FIG. 12 is a flowchart of an exemplary method of manufacturing a toy projectile launcher of the present disclosure.

FIG. 12 is a flowchart 300 of an exemplary method of manufacturing a non-stored energy toy projectile launcher with non-locking handle. In step 310, a barrel in fluid communication with an air chamber is provided, where the barrel is configured to hold a projectile. In step 320, a plunger located within the air chamber is provided, where the plunger is movable between an inactive position and a firing position. Step 330 includes engaging a spring with the plunger, where the spring has a non-energized state when the plunger is in the inactive position, and where the spring has an energized state when the plunger is in the firing position.

In step 340, a non-locking handle is coupleable to the plunger, where the handle moves the plunger from the inactive position to the firing position to compress the spring, and where the non-locking handle is unable to lock the spring at the firing position. In some embodiments, the handle is configured with a gripping area only along a longitudinal axis of the launcher. In certain embodiments, when the handle is in the firing position, the handle and the trigger are spaced at a distance greater than a grip distance of a user's hand. For example, the distance between the handle and the trigger in the firing position may be at least 6 inches. The non-locking handle is coupled to the plunger and to the spring when moving the handle from the inactive position to the firing position, where the spring resists movement of the handle from the inactive position to the firing position. A user's first hand is required to hold the non-locking handle in the firing position while the user's second hand actuates the trigger.

Step 350 includes coupling a plunger release mechanism to the handle, where the plunger release mechanism is capable of coupling and releasing the handle from the plunger. In step 360 a trigger is provided. The trigger is capable of engaging the plunger release mechanism when the handle is held in the firing position, and the trigger is unable to release the plunger release mechanism when the handle is in the inactive position. Releasing the plunger release mechanism decouples the plunger from the handle and enables the air compressed by the plunger to launch the projectile. In the firing position, the trigger is located at a distance from the non-locking handle such that both the non-locking handle and the trigger cannot be engaged simultaneously by a single hand of a user. Both the non-locking handle and the trigger must be engaged simultaneously to launch the projectile.

The flowchart 300 may include a step 345 in which a rail is provided, where the handle slidably moves on the rail. In some embodiments, the plunger release mechanism couples the handle to the rail. The plunger release mechanism may comprise a lever, such that when the handle is in the firing position, the trigger is capable of contacting the lever to decouple the handle from the plunger when the trigger is actuated.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

What is claimed is:

1. A toy projectile launcher comprising:

an air chamber;

a barrel in fluid communication with the air chamber, wherein the barrel is configured to hold a projectile;

a plunger located within the air chamber and movable between an inactive position and a firing position;

a spring engaged with the plunger, the spring having a non-energized state when the plunger is in the inactive position and an energized state when the plunger is in the firing position;

a non-locking handle coupleable to the plunger, wherein the handle moves the plunger from the inactive position to the firing position to compress the spring, and the non-locking handle is unable to lock the spring at the firing position;

a plunger release mechanism coupled to the handle, the plunger release mechanism being capable of coupling and releasing the handle from the plunger; and a trigger capable of engaging the plunger release mechanism when the handle is held in the firing position, the trigger being unable to release the plunger mechanism when the handle in the inactive position, wherein releasing the plunger release mechanism decouples the plunger from the handle and enables the plunger to compress air in the air chamber to launch the projectile, and in the firing position, the trigger is located at a distance from the non-locking handle such that . . . must be engaged simultaneously to launch the projectile.

2. The launcher of claim 1, further comprising:

a rail, wherein the handle slidably moves on the rail.

3. The launcher of claim 2, wherein the plunger release mechanism couples the handle to the rail.

4. The launcher of claim 1, further comprising:

a rod coupled to the trigger, wherein the rod releases the plunger release mechanism when the handle is in the firing position and when the trigger is actuated.

5. The launcher of claim 1, wherein the plunger release mechanism comprises a lever, and when the handle is in the firing position, the trigger is capable of contacting the lever to decouple the handle from the plunger when the trigger is actuated.

6. The launcher of claim 1, wherein the handle is configured with a gripping area only along a longitudinal axis of the launcher.

7. The launcher of claim 1, wherein when the handle is in the firing position, the handle and the trigger are spaced at a distance greater than a grip distance of a user's hand.

8. The launcher of claim 1, wherein the distance between the handle and the trigger in the firing position is at least 6 inches.

9. The launcher of claim 1, wherein the non-locking handle is coupled to the plunger and to the spring when moving the handle from the inactive position to the firing position, the spring resists movement of the handle from the inactive position to the firing position, and a user's first hand is required to hold the non-locking handle in the firing position while the user's second hand actuates the trigger.

10. The launcher of claim 1, wherein the handle is closer to the trigger in the firing position than in the inactive position.

11. The launcher of claim 10, wherein the non-locking handle is coupled to the plunger and to the spring when moving the handle from the inactive position to the firing position, the spring resists movement of the handle from the inactive position to the firing position, and a user's first hand is required to hold the non-locking handle in the firing position while the user's second hand actuates the trigger.

12. A method of manufacturing a toy projectile launcher, the method comprising:

providing a barrel in fluid communication with an air chamber, wherein the barrel is configured to hold a projectile;

providing a plunger located within the air chamber, wherein the plunger has an inactive position and a firing position;

coupling a spring to the plunger, wherein the spring is biased to be in a non-energized state in the inactive position, and wherein the spring is energized in the firing position;

coupling a non-locking handle to the plunger . . . spring at the firing position;

coupling a plunger release mechanism to the handle . . . handle from the plunger; and providing a trigger capable of releasing the plunger release mechanism when the handle is held in the firing position, wherein the trigger is unable to release the plunger release mechanism when the handle is in the inactive position, wherein releasing the plunger release mechanism decouples the plunger from the handle and enables the plunger to compress air in the air chamber to launch the projectile, and wherein in the firing position, the trigger is located at a distance from the non-locking handle . . . by a single hand of a user; and wherein both the non-locking handle and the trigger must be engaged simultaneously to launch the projectile.

13. The method of claim 12, further comprising providing a rail, wherein the handle slidably moves on the rail.

14. The method of claim 13, wherein the plunger release mechanism couples the handle to the rail.

15. The method of claim 12, wherein the plunger release mechanism comprises a lever, and wherein when the handle is in the firing position, the trigger is capable of contacting the lever to decouple the handle from the plunger when the trigger is actuated.

16. The method of claim 12, wherein the handle is configured with a gripping area only along a longitudinal axis of the launcher.

17. The method of claim 12, wherein when the handle is in the firing position, the handle and the trigger are spaced at a distance greater than a grip distance of a user's hand.

18. The method of claim 12, wherein the distance between the handle and the trigger in the firing position is at least 6 inches.

19. The method of claim 12, wherein the non-locking handle is coupled to the plunger and to the spring when moving the handle from the inactive position to the firing position, wherein the spring resists movement of the handle from the inactive position to the firing position, and wherein a user's first hand is required to hold the non-locking handle in the firing position while the user's second hand actuates the trigger.

* * * * *